United States Patent [19]

Lin

[11] Patent Number: 4,582,197

[45] Date of Patent: Apr. 15, 1986

[54] MODEL PACKING DEVICE FOR ICE CREAM

[76] Inventor: Ta-Shun Lin, 3rd Fl. 182 Nanking E. Rd., Sec. 3, Taipei, Taiwan

[21] Appl. No.: 778,270

[22] Filed: Sep. 20, 1985

[51] Int. Cl.[4] ..... B65D 57/00

[52] U.S. Cl. ..... 206/217; 220/90.2; 229/75; 229/1.5 C; 215/1 A; 215/229

[58] Field of Search ..... 206/217; 220/23, 90.2, 220/85 D; 229/75, 1.5 C; 215/1 A, 229

[56] References Cited

U.S. PATENT DOCUMENTS

| | | | |
|---|---|---|---|
| 1,889,111 | 11/1932 | Serr | 206/217 |
| 3,323,706 | 6/1967 | Gereke | 206/217 |
| 3,623,632 | 11/1971 | Chang | 220/90.2 |
| 4,018,904 | 4/1977 | Muraoka | 206/217 |
| 4,036,392 | 7/1977 | Martin | 206/217 |

*Primary Examiner*—Joseph Man-Fu Moy
*Attorney, Agent, or Firm*—Staas & Halsey

[57] ABSTRACT

This invention relates to a new model packing device for ice cream which composed of an inner cup, an outer cup, and a sucker-scoop with the functions of ice cream-scooping and water-sucking. The outer cup for containing water accommodates the inner cup for ice cream, with suitable clearance between the two said cups to store cold water and to receive the said sucker-scoop. In use of the said sucker-scoop can scoop the ice cream as well as suck water, after enjoying ice cream, not only to satisfy thirst but clean the mouth cavity. More than this, cold water between the two said cups has the effect to extend dissolution time of the ice cream contained in the inner cup.

2 Claims, 4 Drawing Figures

MODEL PACKING DEVICE FOR ICE CREAM

BACKGROUND OF THE INVENTION

The ice cream, popular and favorite food among all walks of people, is full of sufficient albumin and sugar, wit abundant nutrition and heating value. However, in spite of its deliciousness, to our disappointment, after we finish enjoying it, some sweet flavor and viscosity remaining in the mouth cavity will make us uncomfortably thirsty. Especially, the remainings of sugar in the mouth cavity will easily ferment between teeth gap to have teeth decayed. Drinking water to satisfy thirst and clean mouth cavity after enjoyment of ice cream is required but it is not only substantially inconvenient to prepare water but difficult to find water outdoors.

Regarding the conventional sucker-scoop of wooden piece, we often fall it during use, very inconvenient for us. Besides, ice cream is inclined to soften or dissolve to lose its original flavor while moved or taken.

OBJECTS OF THE INVENTION

The principal object of the present invention is to solve the above-mentioned disadvantages of the ordinary packing device for ice cream so as to provide a newly designed packing through profound and strict research. Packing ice cream and icy water together, a special sucker-scoop with functions of ice cream-scooping and water-sucking attached, will make it unnecessary for the users to look for water, both preventing teeth being decayed and extending time to dissolve. As stated above, it is very practical to attain several advantages by little payment.

SUMMARY OF THE INVENTION

This invention relates to a new model packing device for ice cream in which an inner cup accommodated within an outer cup and a special sucker-scoop are newly designed, with respect of its clearance between two said cups to store cold water, plus its functions of scooping ice cream and sucking water. The flange of the mouth of inner cup hangs up and connects with the upper rim of the outer cup; the said sucker-scoop with flange on tow ends of its chord portion, with hollow and semi-circular pipe configuration, is attached inside the hole between the two said cups. Thus, we may use the said sucker-scoop to scoop ice cream and suck cold water. This new design cam meet with requirements of having water for cleaning mouth cavity and extending dissolution time of ice cream in the inner cup by the icy layer inside the outer cup.

DETAILED DESCRIPTION OF THE INVENTION

Figure 1:
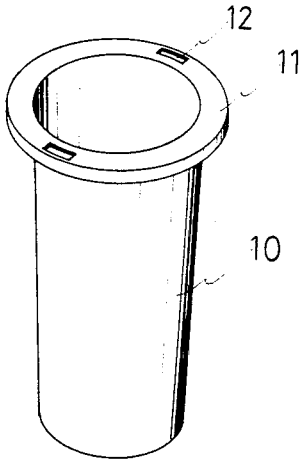
FIG. 1 is a perspective view of an inner cup configuration according to the invention.
Figure 2:
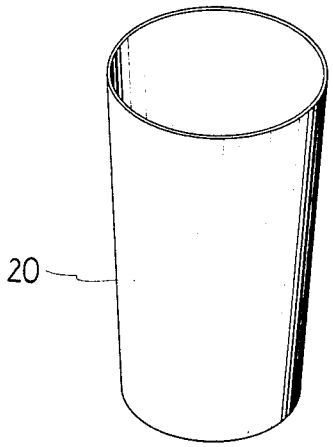
FIG. 2 is a perspective view of an outer cup configuration according to the invention.
Figure 3:
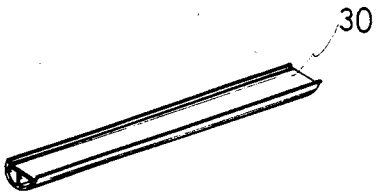
FIG. 3 is a perspective view of a sucker-scoop configuration according to the invention.
Figure 4:
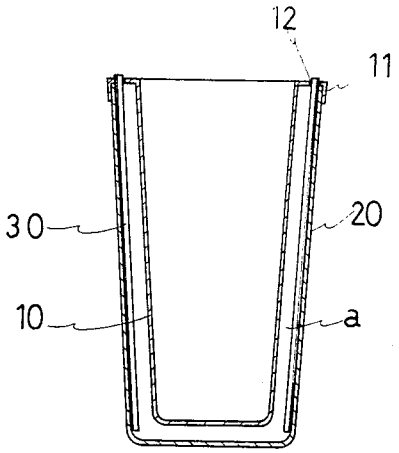
FIG. 4 is a half sectional elevation of the FIGS. 1, 2 and 3 assembly.

Referring the drawings, this invention consists of an inner cup 10, an outer cup 20 and a special sucker-scoop 30 with functions of sucking water and scooping ice cream. A cap rim 11 by the mouth of inner cup 10 has two circular holes 12 on both sides whose diameter is exactly fitted in with mouth size of the outer cup 20. When the outer cup 20 accommodates the inner cup 10, cap rim 11 of the latter exactly encases the mouth of the former. The difference between the outside diameter and depth of the said cups forms a clearance region (a) between them; the special sucker-scoop 30 is a circulerarched pipe in hollow configuration, whose size is identical to the circular hole 12 of inner cup and whose length to the depth of outer cup, so that the sucker-scoop 30 may insert into the similar semi-circular holes12 placed within the outer cup 20 when packed.

In this invention, an outer cup 20 accommodates water with volume equal to the difference between outer cup 20 and inner cup 10; an inner cup 10 containing ice cream is accommodated within the outer cup 20; water is filled in the clearance region (a) between the two cups; nad a special sucker-scoop 30 may be inserted into the sime-circular holes 12 within outer cup 20. The last procedure is to put this invention in frozen room, by sealing the mouth of outer cup 20 with cover or hard paper, the water inside the region (a) will be frozen.

As mentioned above, the invention has advantages as follows:

(1) The outer frozen region (a) will enable the ice cream in the inner cup keep cold to extend its dissolution time, making up the disadvantage of its inclination to dissolve when taken or moved.

(2) With ice cream inside the inner cup and water inside the outer cup, the appearance of this invention will make the customers think it cheap to satisfy their requirement. For venders, this will also reduce their cost certainly.

(3) The special sucker-scoop has functions of sucking water and scooping ice cream. A hollow inside it is to suck water and the semi-circular configuration formed like a spoon is to scoop ice cream, more convenient than those ordinary ones of wooden piece.

(4) The icy layer region (a) is an elite portion of this invention-source of water. In use, holding the outer cup with our hands and slightly twisting to break the thin ice layer, we may easily pick out the special sucker-scoop. Following this, the icy layer will dissolve into cold water by means of enlargement of surface area and warmth from our hands.

(5) Packing ice cream and icy water together, the invention may attain the events of having water to satisfy thirst after eating ice cream as well as cleaning the mouth cavity to prevent teeth being decayed.

I claim:

1. A new model of packing device for ice cream comprising an inner cup, an outer cup and special sucker-scoop with functions of scooping ice cream and sucking water; body of inner cup fits in with outer cup in proper shrinkage, mouth of the inner cup provides cap rim along which there are holes conformed to the outer shape of sucker-scoop to accommodated top rim of outer cup and body of inner cup contained within outer cup, with suitable clearance between both cups to store water; moreover, the sucker-scoop may be inserted into the holes of cap rim and sealed by top cover; Thus, ice cream cold water and sucker-scoop will be packed together.

2. A new model packing device for ice cream as claimed in claim 1 wherein the special sucker-scoop with functions of sucking water and scooping ice cream is featured by hollow and semi-circular pipe configuration.

* * * * *

UNITED STATES PATENT AND TRADEMARK OFFICE

CERTIFICATE OF CORRECTION

PATENT NO. : 4,582,197

DATED : April 15, 1986

INVENTOR(S) : Ta-Shun Lin

It is certified that error appears in the above-identified patent and that said Letters Patent is hereby corrected as shown below:

Column 1, line 48 [please note line numbering is not accurate], "cam" should be --can--;
line 64, after "Referring" insert --to--.

Column 2, line 11, "les12" should be --les 12--;
line 17, "nad" should be --and--;
line 18, "sime-circular" should be --semi-circular--;
line 60, ";" should be --.--.

Signed and Sealed this

*Twenty-ninth* Day of *July 1986*

[SEAL]

*Attest:*

DONALD J. QUIGG

*Attesting Officer*

*Commissioner of Patents and Trademarks*